United States Patent [19]

Perreault

[11] 4,158,187

[45] Jun. 12, 1979

[54] MEANS FOR AFFIXING FERRULES TO A FUSE CASING

[75] Inventor: Richard J. Perreault, Amesbury, Mass.

[73] Assignee: Gould Inc., Rolling Meadows, Ill.

[21] Appl. No.: 819,064

[22] Filed: Aug. 5, 1977

[51] Int. Cl.[2] ..... H01H 85/02

[52] U.S. Cl. ..... 337/248; 337/252

[58] Field of Search ..... 337/248, 251, 252, 253, 337/236

[56] References Cited

U.S. PATENT DOCUMENTS

| | | | |
|---|---|---|---|
| 3,483,501 | 12/1969 | Kozacka | 337/248 |
| 3,529,270 | 9/1970 | Kozacka | 337/248 |
| 4,063,208 | 12/1977 | Bernatt | 337/248 |

FOREIGN PATENT DOCUMENTS

| | | | |
|---|---|---|---|
| 665052 | 1/1952 | United Kingdom | 337/252 |

*Primary Examiner*—Harold Broome
*Attorney, Agent, or Firm*—Erwin Salzer

[57] ABSTRACT

Means for affixing the ferrules to a fuse casing include heat resistant elastomeric elements mounted between the rims of a fuse casing and a pair of ferrules, said elements tending to move said pair of ferrules away from the fuse casing in a direction longitudinally thereof. The pair of ferrules having portions engaging circular grooves in said casing and thereby resisting any movement of said pair of ferrules under the forces of said heat resistant elastomeric elements.

3 Claims, 4 Drawing Figures

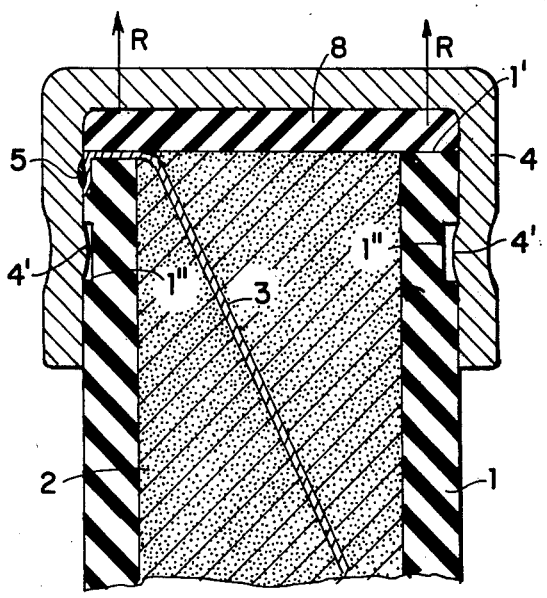
R
8
R
1'
5
4
4'
1"
1"
4'
3
2
1

MEANS FOR AFFIXING FERRULES TO A FUSE CASING

BACKGROUND OF THE INVENTION

The closest prior art known to applicant is U.S. Pat. No. 3,644,861 to Aloysius Fister, 02/22/72 for PROTECTOR FOR ELECTRIC CIRCUITS. According to that patent the casing of a fuse is provided with annular grooves adjacent opposite ends of the outer surface thereof and has yieldable annuli disposed within those grooves. The axially inner edges of the ferrules are cold formed into said annuli and thus firmly positioned relative to the casing of the fuse. The deformation of the annuli sets up a force of reaction opposite to that exerted upon the annuli by deformation of the ferrules. This force of reaction can be sub-divided into two components of which one is in a direction longitudinally of the fuse tube and the second is at right angles to the former. The component in a direction longitudinally of the fuse tube is useful since it tends to maintain the ferrules in position. The component at right angles to the longitudinal component is useless, or even undesirable, since it tends to expand the ferrules in radial direction. To obtain a given component in axial direction requires relatively large annuli, and relatively large grooves in the casing of the fuse which tend to weaken the latter.

It is the prime object of this invention to provide a means for affixing ferrules to a fuse casing, particularly a casing which is made of a material that has little resiliency, which is free from the above limitations.

SUMMARY OF THE INVENTION

Fuses according to the present invention include a tubular casing containing a granular arc-quenching filler. A fusible element embedded in said filler conductively interconnects a pair of ferrules mounted on the ends of said casing. A pair of heat resistant elastomeric elements is mounted between the rims of said casing and said pair of ferrules and tends to move said pair of ferrules in a direction longitudinally of said casing. Said casing has a pair of circular grooves engaged by portions of said pair of ferrules and resisting movement of said pair of ferrules in accordance with the forces exerted by said pair of resilient elements.

BRIEF DESCRIPTION OF THE DRAWINGS

FIG. 1 is a longitudinal section of one end of a fuse embodying this invention.

Only one end the fuse embodying this invention is shown in the drawings since both ends are identical.

DESCRIPTION OF PREFERRED EMBODIMENTS

Referring now to the drawings, numeral 1 has been applied to indicate a tubular casing of electric insulating material having flat rims and containing a granular arc-quenching filler 2 such as, for instance, quartz sand. A fusible element 3 is embedded in filler 2. It conductively interconnects a pair of ferrules 4, of which but one is shown. Fusible element 3 is blind soldered on both ends thereof to ferrules 4 thereby conductively interconnecting the same. A heat resistant elastomeric element 8 is mounted between the rim 1' of casing 1 and ferrule 4, tending to move ferrule 4 in a direction longitudinally of casing 1, i.e. in the direction of arrows R. The heat resistant elastomeric element 8 has a cross-section at least as large as the cross-section of the rim of the casing 1, so that the resilient forces of element 8 produced when ferrule 4 is compressed over casing 1 onto element 8 are distributed evenly over the entire rim of said casing and the axially inner surface of ferrule 4 which is coextensive with the axial rim of said casing. Element 8 does not radially overlap the outboard radial edge of said rim thereby ensuring substantially longitudinally directed resilient forces, i.e. in the direction of arrows R. Casing 1 has a circular groove 1'' engaged by a portion 4' of ferrule 4, and thus resisting movement of ferrule 4 in accordance with the forces exerted by said resilient element 8. The latter may take the form of a circular disc an O-ring, or a washer. The opposite end of the fuse is closed in the same way by a circular disc 8, and the ferrules 4 rolled or crimped directly into circular groove 1''. The portions 4' of ferrules 4 directly engaging grooves 1'' may or may not be the axially inner ends of ferrule 4. In FIG. 1 the portions of ferrule 4 are situated at points thereof approximately midway between the end surfaces of the ferrules and the axially inner ends thereof.

It will be apparent from a consideration of FIG. 1 that in the above described structure the elastic element 8, is far less exposed to the action of ambients than in the prior art structures including annular members arranged in grooves of the casing. This may be of considerable advantage when the resilient members are subjected to the action of an adverse atmosphere. In the structure of FIG. 1 the fusible element 3 is blind soldered 5 on both ends thereof to ferrules 4. This means that the washer or disc 8 must be sufficiently heat resistant to allow performance of the blind soldering operation. To comply with this requirement, however, does not involve any difficulties.

I claim as my invention:

1. An electric fuse including (a) a tubular casing of electric insulating material having flat rims and containing a granular arc-quenching filler;

(b) a fusible element embedded in said filler, conductively interconnected by blind solder joints to a pair of ferrules mounted on the axial ends of said casing;

(c) a pair of heat resistant elastomeric elements each mounted between one of said rims of said casing and one of said pair of ferrules, said elements having a cross-section at least as large as the cross section of said rims of said casing, tending upon compression to move said pair of ferrules in a direction longitudinally of said casing;

(d) said casing having a pair of circular grooves directly engaged by portions of said pair of ferrules once having been rolled or crimped into said grooves and resisting movement of said pair of ferrules in accordance with the forces exerted by said pair of heat resistant elastomeric elements.

2. An electric fuse as specified in claim 1 wherein said pair of heat resistant elastomeric elements are formed by a pair of annular discs.

3. An electric fuse as specified in claim 1 wherein said pair of heat resistant elastomeric elements are a pair of members coextensive with the rims of said casing.

* * * * *